US009756412B1

(12) United States Patent
Bacon

(10) Patent No.: US 9,756,412 B1
(45) Date of Patent: Sep. 5, 2017

(54) CIRCUMAURAL TO SUPRA-AURAL CONVERTIBLE HEADPHONE EARCUPS

(71) Applicant: Apple Inc., Cupertino, CA (US)

(72) Inventor: Cedrik Bacon, Los Gatos, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/019,813

(22) Filed: Feb. 9, 2016

(51) Int. Cl.
*H04R 25/00* (2006.01)
*H04R 1/10* (2006.01)

(52) U.S. Cl.
CPC ..... *H04R 1/1008* (2013.01); *H04R 1/1066* (2013.01)

(58) Field of Classification Search
CPC ..... H04R 1/1008; H04R 1/1066
See application file for complete search history.

(56) References Cited

U.S. PATENT DOCUMENTS

| | | | | |
|---|---|---|---|---|
| 5,024,031 | A | 6/1991 | Hoberman | |
| 6,412,593 | B1 * | 7/2002 | Jones | H04R 1/1008 181/129 |
| 6,788,797 | B2 | 9/2004 | Kim | |
| 8,111,858 | B2 | 2/2012 | Sapiejewski | |
| 8,416,960 | B2 | 4/2013 | D'Agostino et al. | |
| 8,755,555 | B2 | 6/2014 | Dougherty et al. | |
| 2006/0239446 | A1 | 10/2006 | Gunter et al. | |
| 2007/0092098 | A1 | 4/2007 | Kaderavek | |
| 2012/0207320 | A1 | 8/2012 | Avital | |

* cited by examiner

*Primary Examiner* — Tuan D Nguyen
(74) *Attorney, Agent, or Firm* — Blakely Sokoloff Taylor & Zafman LLP

(57) ABSTRACT

A convertible earcup for a headphone. The earcup includes an earcup frame, a driver positioned within the earcup frame and an earpad coupled to the earcup frame. The earpad is operable to be converted between a first configuration in which the earpad comprises a first diameter and a second configuration in which the earpad comprises a second, different diameter. A convertible headphone system including a set of earcups. Each earcup within the set of earcups includes a speaker unit and an earpad, and the earpad is convertible between a first diameter and a second diameter.

20 Claims, 9 Drawing Sheets

CIRCUMAURAL TO SUPRA-AURAL CONVERTIBLE HEADPHONE EARCUPS

FIELD

An embodiment of the invention is directed to a convertible headphone having earcups that can be converted between around the ear earcups (circumaural) and over the ear earcups (supra-aural). Other embodiments are also described and claimed.

BACKGROUND

Whether listening to a portable media player while traveling, or to a stereo or theater system at home, consumers often choose headphones. Headphones typically include a pair of earcups that are placed on the user's ears and are held together by a headband. The earcups typically include earpads for user comfort and/or sealing of the earcup to the user's head, and are of a fixed size and shape. In this aspect, headphones can be classified into two general categories based on the size of the earcup and associated earpads, namely circumaural headphones or supra-aural headphones.

Circumaural headphones have earpads the completely surround the user's ear and press on the user's head. Circumaural headphones are often referred to as full size headphones. In some cases, the earpads seal to the user's head to provide sound attenuation. Due to the size of the earcups and pads, however, circumaural headphones can be heavy and inconvenient for daily use.

Supra-aural headphones have earpads that are smaller than those of circumaural headphones and press on the user's ears, instead of the head. Supra-aural headphones are therefore typically smaller than circumaural headphones and may be more suitable for daily use and travel. Because the earpads of supra-aural headphones can rest on the user's ears, however, they can become uncomfortable after a period of time and achieve less sound attenuation than circumaural headphones.

SUMMARY

As previously discussed, headphones are generally designed with earcups having a fixed size. The instant invention improves on conventional headphones by providing headphone earcups that can be converted between over the ear (e.g., supra-aural) and around the ear (e.g., circumaural) configurations, and any size in between. For example, the earcup may have an expandable cushion or telescoping ring connected to a frame system similar to a Hoberman Sphere® which allows for the expansion of the earcup and associated earpad to adapt to the user's desired size. In addition, it is noted that to maintain the acoustic performance of the headphones, a distance from the ear canal entrance and/or pinna of the user's ear and a face of the speaker unit (e.g., the diaphragm) is maintained as constant as possible. It has been found that changes in a diameter of the earcup have limited impact in acoustic performance in the mid-band range and to open ear gain when the distance remains constant.

More specifically, an embodiment of the invention is a convertible earcup for a headphone. The convertible earcup may include an earcup frame, a driver positioned within the earcup frame, and an earpad coupled to the earcup frame. The earpad is operable to be converted between a first configuration in which the earpad has a first diameter and a second configuration in which the earpad has a second, different diameter. The earcup frame may include a plurality of struts extending radially outward from the driver to the earpad. In addition, the earcup frame may include a plurality of articulated frame members extending radially outward from the driver to the earpad. The articulated frame members may be operable to expand and contract to convert the earpad between the first configuration and the second configuration. The earcup frame may further include an acoustic mesh for tuning an acoustic performance of the earcup. In one aspect, when the earpad is in the first configuration, the earpad may be dimensioned to encircle an ear. In another aspect, when the earpad is in the second configuration, the earpad may be dimensioned to rest on an ear. In addition, when the earpad is at the first diameter, the earpad may be a circumaural earpad. Further, when the earpad is at the second diameter, the earpad may be a supra-aural earpad. Still further, the earpad may be a ring shaped member including an elastomeric material. In addition, the earpad may include a plurality of telescoping sections that form a ring around the driver or speaker. The earcup may also include a position sensor or an acoustic sensor coupled to the earpad to detect whether the earpad is in the first configuration or the second configuration.

In another embodiment, an earcup for a headphone includes an earcup frame that is adjustable between a first configuration and a second configuration, a speaker unit positioned within the earcup frame and an earpad coupled to the earcup frame. The earpad may include a first diameter when the earcup frame is in the first configuration and a second diameter when the earcup frame is in the second configuration. Still further, the earcup frame may include a plurality of struts operable to adjust the earcup frame between the first configuration and the second configuration.

In other embodiments, the earcup frame may include at least two jointed frame members, and the jointed frame members contract or expand to adjust the earcup frame between the first configuration and the second configuration. Still further, the earcup frame may include a plurality of frame members extending radially outward from the speaker unit to the earpad. In some cases, at least one of the plurality of frame members may include an acoustic opening for tuning an acoustic performance of the earpad. In addition, a volume defined by the earcup frame in the first configuration is different than a volume defined by the earcup frame in the second configuration. The earcup may also include a covering coupled to the earcup frame. The covering may include a porous material operable to tune an acoustic performance of the earcup. In one embodiment, a distance between a face of the speaker unit and an ear around which the earcup frame is positioned remains constant in the first configuration and the second configuration.

In another embodiment, a convertible headphone system is disclosed. The headphone system includes a set of earcups. Each of the earcups may include a speaker unit and an earpad that is convertible between a first diameter and a second diameter. The earcup may be a circumaural earcup in the first diameter and a supra-aural earcup in the second diameter.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description. The terms "over", "to", and "on" as used herein may refer to a relative position of one feature with respect to other features. One feature "over" or "on" another feature or bonded "to" another feature may be directly in contact with the other feature or may have one or more intervening layers. In addition, the use of relative terms throughout the description, such as "top", "above or "upper" and "bottom", "under" or "lower" may denote a relative position or direction. For example, a "top edge", "top end" or "top side" may be directed in a first axial direction and a "bottom edge", "bottom end" or "bottom side" may be directed in a second direction opposite to the first axial direction.

Figure 1:
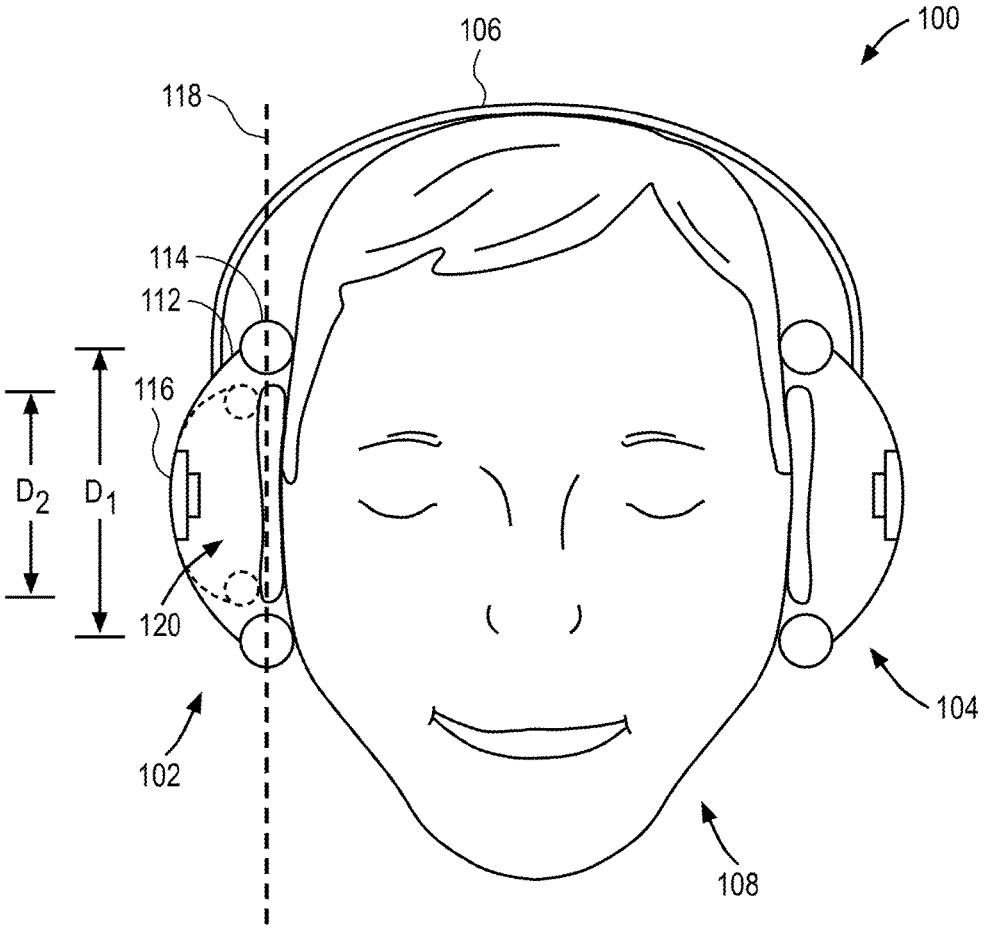
FIG. 1 illustrates a schematic diaphragm of one embodiment of a headphone having convertible earcups.

FIG. 1 illustrates a schematic diaphragm of one embodiment of a headphone having convertible earcups. Headphone 100 may include a set of earpieces, for example, earcups 102 and 104, which are connected together by a head band 106. Head band 106 may be dimensioned to fit over the user's head and align earcups 102, 104 with the user's ears 110. Earcup 102 may include an earcup frame 112, a transducer 116 positioned within the earcup frame 112 and an earpad 114 connected to the earcup frame 112. The earcup frame 112 may, in some embodiments, be dimensioned to form an acoustic chamber 120 which helps to contain and direct sound generated by the transducer 116 to the user's ear 110. Transducer 116 may be any type of electric-to-acoustic transducer such as a speaker driver or loudspeaker having a pressure sensitive diaphragm and circuitry configured to produce a sound in response to an electrical audio signal input. The electrical audio signal may be a music signal input to transducer 116 by a sound source. The sound source may, for example, be an audio device capable of outputting an audio signal, for example, an audio electronic device such as a portable music player, home stereo system or home theater system capable of outputting an audio signal. The earpad 114 may be designed to comfortably contact, and in some cases seal to, the user's head and/or ear. For example, earpad 114 may be a cushion or elastomeric member (e.g., an elastomer such as polyurethane or silicon based material) having a ring or ellipsoid shape similar to that of the ear. It should be understood that although only earcup 102 is described in detail, earcup 102 and earcup 104 are substantially the same, therefore each of the aspects described in reference to earcup 102 apply to earcup 104.

In order to improve the versatility and/or performance of headphone 100 between, and among, users, earcup 102 may be convertible between a circumaural earcup and a supra-aural earcup. In other words, earcup 102 may be adjustable between a size in which it encircles ear 110 and rests on the user's head 108 and a size in which it rests or presses on ear 110. For example, earcup 102 and the associated earpad 114 may have a diameter that is modifiable between a first diameter $D_1$ and a second diameter $D_2$, as measured along an axis 118 substantially parallel to a face of transducer 116. Diameter $D_1$ may, for example, correspond to that of a circumaural earcup that completely encircles the user's ear 110 as shown in FIG. 1. Diameter $D_2$ may, for example, correspond to that of a supra-aural earcup that rests and/or presses on the user's ear 110 as shown in dashed lines in FIG. 1. In other words, diameter $D_1$ may be greater than diameter $D_2$, or said another way diameter $D_2$ is less than diameter $D_1$. Although only diameters $D_1$ and $D_2$ are shown, it should be understood that earcup 102 and/or the associated earpad 114 may have a diameter anywhere within a range that is between diameters $D_1$ and $D_2$. The diameters $D_1$ and $D_2$ may be measured from the points where the earcup frame 112 and the earpad 114 connect, or otherwise intersect, therefore both the earcup frame 112 and earpad 114 may be referred to herein as having diameters $D_1$ or $D_2$. For example, a diameter of the earcup frame 112 may be measured from the circumference of earcup frame 112 as defined by the ends of the frame, which attach to earpad 114, and a diameter of earpad 114 may be measured from a circumference of earpad 114 as defined through a center of earpad 114. In addition, in some embodiments, a corresponding change in the volume of the acoustic chamber 120 formed by earcup 102 may occur. For example, a volume of acoustic chamber 120 of earcup 102 at diameter $D_1$ may be greater than a volume of acoustic chamber 120 of earcup 102 at diameter $D_2$.

It is noted that the changes in diameter and/or volume of earcup 102 may be used to modify, control and/or improve an acoustic performance of earcup 102, or may simply be used to improve user comfort. For example, when earcup 102 has a diameter $D_1$, earcup 102 encircles ear 110 and can seal to the user's head, thus improving sound attenuation;

this is in comparison to a non-sealing earcup diameter (e.g., diameter $D_2$). Therefore, such a configuration may be desirable when a level of undesirable ambient sounds is high. When the ambient sound levels decrease, earcup 102 can be converted to a diameter $D_2$, such that it rests on the ear and allows some ambient noises to enter earcup 102, thus creating a more "open" sounding user experience. Still further, the volume of acoustic chamber 120 within earcup 102 may be modified to, for example, give the user a more open or less open listening experience. In addition, it is noted that although a diameter and/or volume of earcup 102 may change, a distance between transducer 116 and the ear 110 (e.g., an opening to the ear canal) should remain relatively constant in order to maintain the desired acoustic performance among the various earcup sizes.

Figure 2:
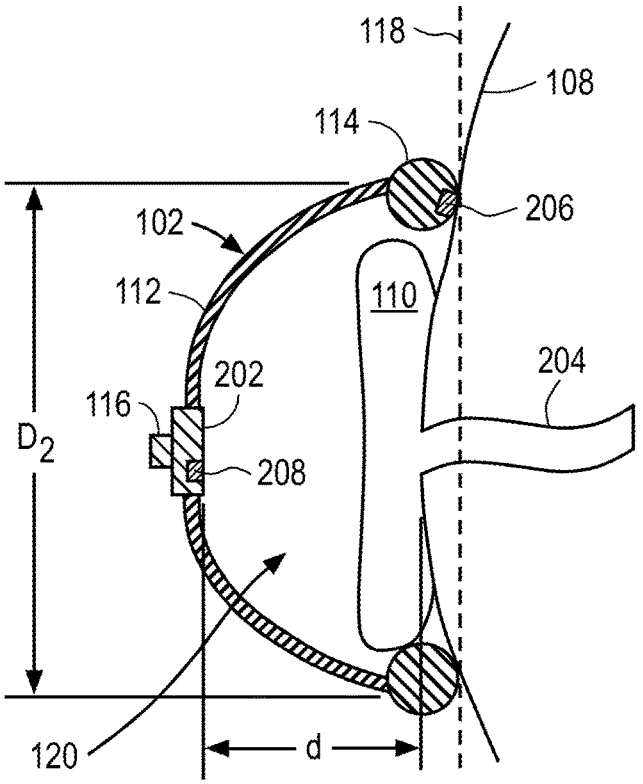
FIG. 2 illustrates a schematic cross-sectional side view of one embodiment of a headphone earcup of the headphone in FIG. 1 in a first configuration.

FIG. 2 illustrates a schematic cross-sectional side view of one embodiment of a headphone earcup of the headphone in FIG. 1 in a first configuration. From this view, it can be seen that in a first configuration, earcup 102 is at the first diameter $D_1$ and completely encircles ear 110. In some cases, earpad 114 seals to the user's head 108 so that no sound, or only minimal sound, can enter earcup 102, thereby providing sound attenuation. In addition, as previously discussed, a distance (d) between a sound output face 202 (e.g., a diaphragm) of transducer 116 and the ear 110, more specifically an opening to the ear canal 204, remains consistent between the first and second earcup configurations so that the acoustic performance of the earcup is consistent among the various earcup sizes.

In addition, in some embodiments, an optional pressure sensor 206 and/or acoustic sensor 208 may be included in earcup 102. The pressure sensor 206 may, for example, be any type of sensor that is capable of detecting a pressure between earpad 114 and the user. In this aspect, the pressure sensor 206 may be positioned within a portion of earpad 114 that contacts the user. The detected level of pressure can, in turn, be used to determine the configuration of the earcup 102. For example, an overall pressure on the earpad 114 may be greater when it presses on the user's head (e.g., a circumaural configuration) than when earpad 114 is against the user's ear (e.g., a supra-aural configuration). Therefore, when the pressure detected by pressure sensor 206 is within a first pressure range or above/below a predetermined pressure threshold, it is determined that the earcup 102 is in the first configuration, for example, a circumaural earcup configuration. When the pressure detected by the pressure sensor 206 is within a second pressure range or above/below the predetermined threshold pressure level, it is determined that the earcup 102 is in the second configuration, for example, a supra-aural earcup configuration. In some cases, the first pressure range may be greater than the second pressure range.

The acoustic sensor 208 may, for example, be positioned within the acoustic chamber 120 of earcup 102 such that it can detect a level of ambient sound within acoustic chamber 120 and/or any changes in a frequency response of the transducer 116 within acoustic chamber 120. For example, in one embodiment, acoustic sensor 208 may be a microphone positioned in front of transducer 116 (e.g., mounted to transducer 116) that is capable of detecting a change in a frequency response and/or sensitivity of transducer 116, which may occur due to the change in earcup size. In other embodiments, acoustic sensor 208 may be an error microphone or reference microphone that operates in a similar manner to an error microphone used in an active noise control (ANC) system. For example, reference microphone may be designed to detect earcup noise (e.g., ambient sound) within acoustic chamber 120. The reference microphone may be any type of acoustic-to-electric transducer or sensor having a pressure sensitive diaphragm and circuitry capable of converting earcup noise into an electrical signal (e.g., a MEMS microphone, an analog microhpone or an electret microphone). The earcup noise detected by acoustic sensor 208 may then be converted to an earcup noise electrical signal and transmitted to a processing unit. The processing unit may then process both the earcup noise electrical signal and signal input to transducer 116 for output to the user (e.g., compare the signals) to determine a level of ambient noise present within earcup 102. An ambient noise level within or below a first predetermined acoustic range indicates that the earcup 102 is sealed around the ear (e.g., minimal ambient noise is leakage into the earcup). In turn, an ambient noise level within a second predetermined threshold range (e.g., a range above the first acoustic range) indicates that the earcup 102 is not acoustically sealed against the user (e.g., significant ambient noise leakage into earcup). Based on this information, it can be determined whether the earcup 102 is in the first configuration in which it is sealed around the ear 110 (e.g., circumaural) or resting on the ear 110 (e.g., supra-aural). In some cases, the acoustic sensor 208 may be part of a closed feedback system from the microphone to the transducer 116.

The information regarding the earpad configuration (e.g., size) that is obtained using pressure sensor 206 and/or acoustic sensor 208 may then be used to actively compensate for any undesirable changes in acoustic performance among the various earcup sizes. For example, a drop in speaker sensitivity may occur when a volume of earcup chamber 120 is increased. The frequency response, however, can be maintained among the earcup sizes by adapting the signal output to transducer 116 compensate for the drop in sensitivity. For example, the power or voltage input to the speaker can be increased when it is determined that the volume of earcup chamber 120 has increased (e.g., earcup 102 is in the first configuration) to compensate for any drop in sensitivity. Since the sensors 206, 208 can be used to detect the earcup size and/or output of the transducer 116, the system is adaptive and actively compensates for any possible sensitivity, acoustic impedance and/or frequency response changes.

Figure 3:
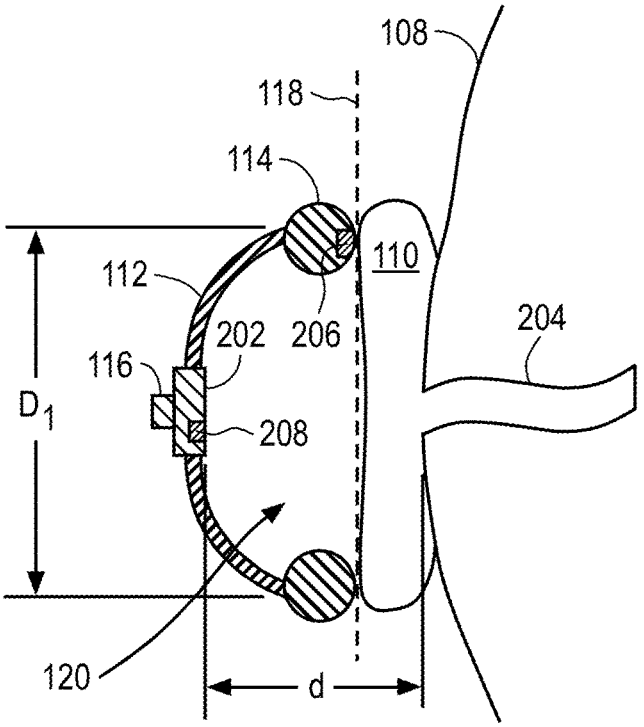
FIG. 3 illustrates a schematic cross-sectional side view of one embodiment of the headphone earcup of FIG. 2 in a second configuration.

FIG. 3 illustrates a schematic cross-sectional side view of one embodiment of the headphone earcup illustrated in FIG. 2 in a second configuration. In particular, from this view, it can be seen that earcup 102 is at the second diameter, $D_2$, which is less than the first diameter, $D_1$. Thus, in this configuration, earpad 114 of earcup 102 rests on ear 110, as opposed to the user's head 108. In other words, earcup 102 is supra-aural. The distance (d) between transducer 116 and the ear 110, however, remains constant between the first configuration shown in FIG. 2 and the second configuration of FIG. 3, as previously discussed. It should further be noted that, as previously discussed, although two diameters $D_1$ and $D_2$ are illustrated, earcup 102 may be adjusted to any diameter within a diameter range between $D_1$ and $D_2$ as desired by a user.

Figure 4:
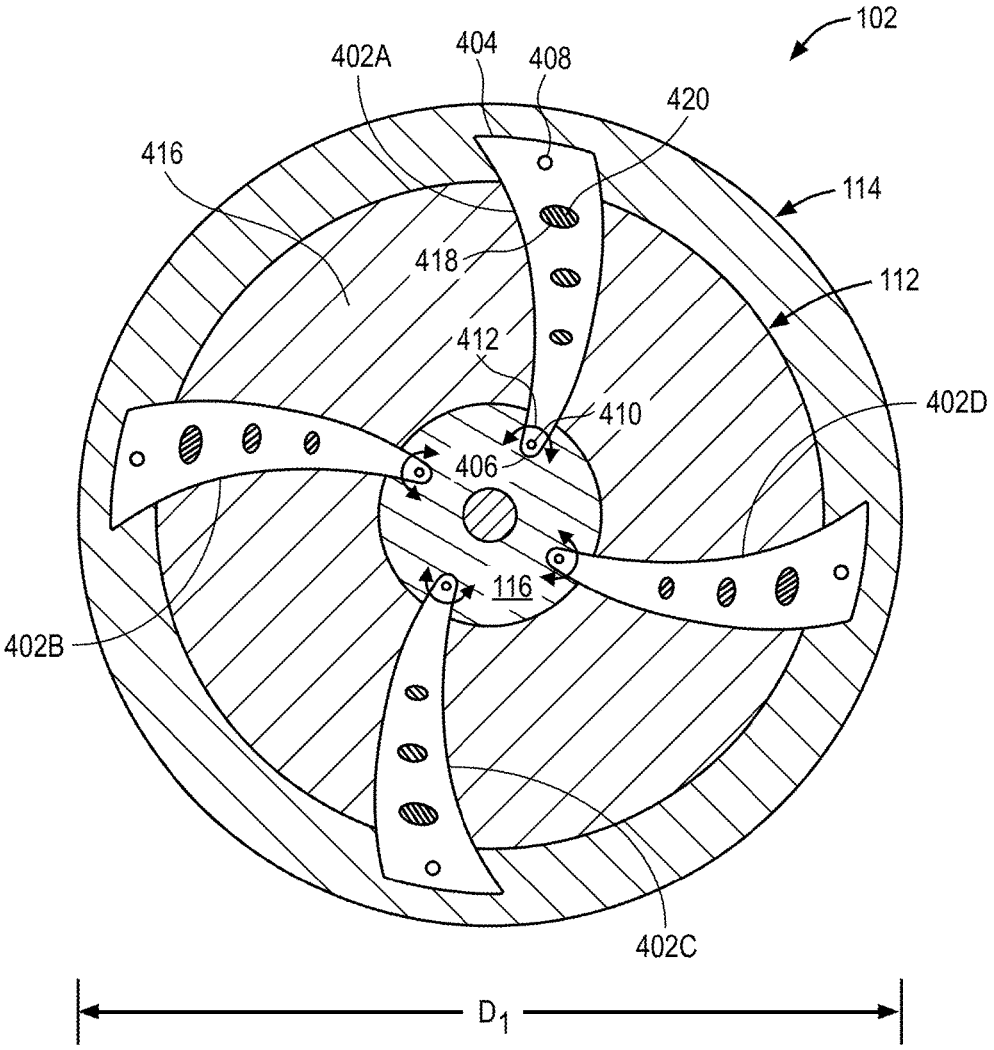
FIG. 4 illustrates a schematic top plan view of one embodiment of a headphone earcup in a first configuration.
Figure 5:
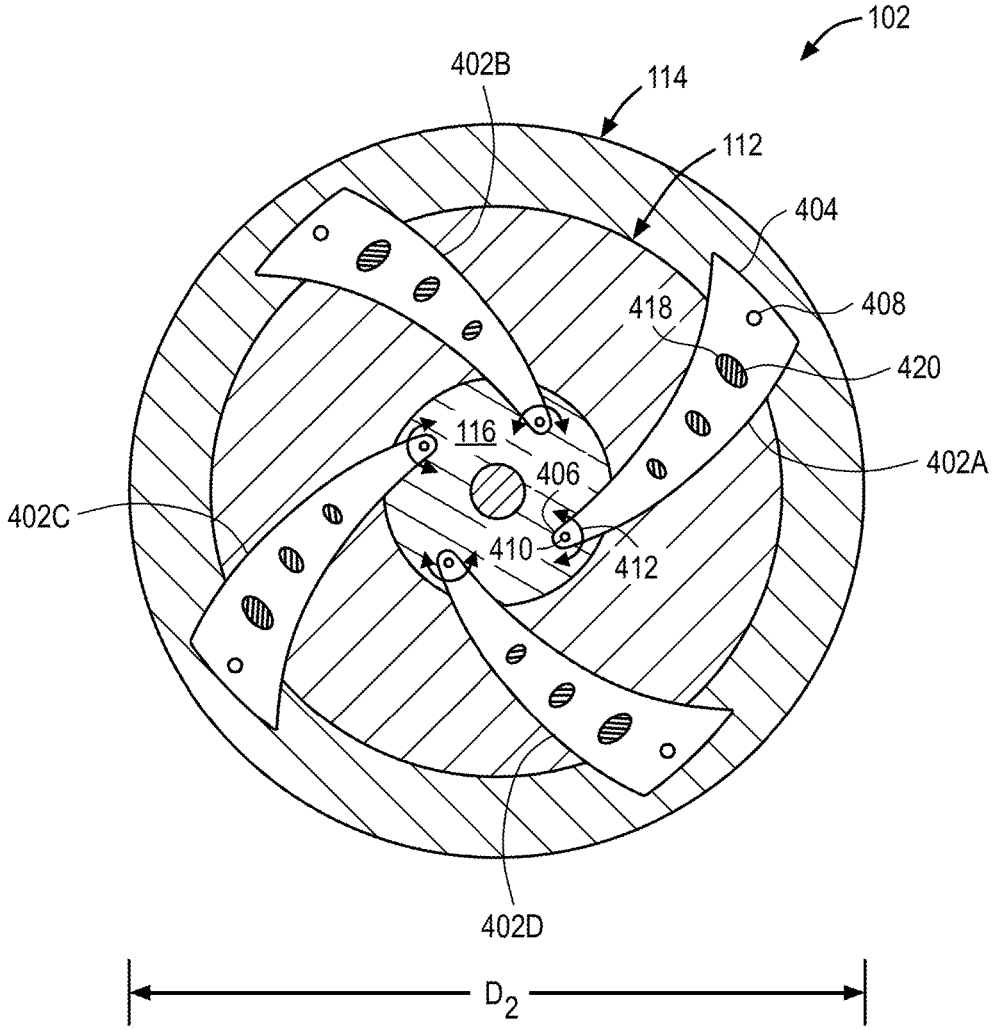
FIG. 5 illustrates a schematic top plan view of one embodiment of the headphone earcup of FIG. 4 in a second configuration.

FIG. 4 illustrates a schematic top plan view of one embodiment of a headphone earcup in a first configuration. Earcup 102 is substantially the same as, and operates in the same manner as, the earcup 102 described in reference to FIGS. 1-3. In this aspect, as previously discussed, earcup 102 includes earcup frame 112, earpad 114 connected to earcup frame 112 and transducer 116 also connected to earcup frame 112. From this view, it can be seen that earcup frame 112 includes additional features to facilitate the conversion of earcup 102 between the first and second configurations (e.g., between a circumaural and a supra-aural earcup). In particular, in this embodiment, earcup frame 112 includes one or more frame members 402A, 402B, 402C and 402D extending radially outward from transducer 116 to earpad 114. Frame members 402A-402D may, in some embodiments, be cantilever like members, fin like members, struts, trusses, beams or the like. The frame members 402A-402B may be curved toward earpad 114 so as to form a cup, cone or other similarly shaped acoustic chamber around the ear (as shown in FIGS. 2-3). For example, in one embodiment, frame members 402A-402D may be formed of a plastic material or the like that can be curved (such as by molding) to the desired shape and size. In addition, in some embodiments, frame members 402A-402D may be curved or bent in a lateral direction (e.g., from side-to-side). A lateral bend or curve as shown may be desirable so that when earcup 102 is converted to have a smaller diameter by pulling frame members 402A-402D in toward transducer 116 as shown in FIG. 5, frame members 402A-402D can pull earpad 114 toward transducer 116 without intersecting with one another. It should further be understood that although four frame members 402A-402D are shown, any number of frame members may be provided.

Each of frame members 402A-402D may include an outer end 404 attached to earpad 114 and an inner end 406 attached to transducer 116. Both outer and inner ends 404, 406 of each of frame members 402A-402D may be pivotally attached to the earpad 114 and transducer 116, respectively, by attachment members 408, 410, respectively. The attachment members 408, 410, may for example, be pins or any other type of attachment member that holds two structures together and allows one structure to pivot with respect to the other. It should further be recognized that although frame members 402A-402D are shown attached to transducer, they may be attached to any other mounting member centrally located within earcup 102, for example, a central part of a casing to which transducer 116 is mounted.

Frame members 402A-402D may pivot around one or both of attachment members 408, 410 as shown by arrow 412 to convert earcup 102 between the first and second configurations. For example, as can be seen from FIG. 4, when one or more of frame members 402A-402D are positioned such that a length dimension of the member (e.g., in a radial direction with respect to transducer 116) is substantially perpendicular to a line tangent to the surface of transducer 116, a circumference of earpad 114 is maximized and earpad 114 is at its largest diameter, or $D_1$. To reduce the circumference or diameter of earpad 114, the inner ends 406 of frame members 402A-402D pivot in a direction of arrow 412 such that the outer ends 404, which are connected to earpad 114, rotate around transducer 116 pulling earpad 114 in toward transducer 116, which in turn reduces the circumference and diameter of earpad 114 to $D_2$, as shown in FIG. 5. The movement of frame members 402A-402B may be driven manually by a user, or automatically, such as by a controller within earcup 102.

Earpad 114 may be a ring shaped structure that can expand and contract based on the movement of frame members 402A-402D, while still maintaining a ring shape. For example, earpad 114 may be made of a continuous piece of flexible elastic material, elastomeric material, foam, polyurethane or silicon based material. Alternatively, earpad 114 may be made of curved material sections, which are drawn close or farther apart depending upon the movement of frame members 402A-402D.

Earcup frame 112 may further include a cover 416 that covers, or otherwise fills in, the gaps between frame members 402A-402D to complete the acoustic chamber. Representatively, cover 416 may be made of a material, such as a fabric or plastic, that can fit over and/or around the frame members 402A-402D and then be attached thereto to create an enclosed chamber. In one embodiment, cover 416 may be formed of an acoustic or otherwise open texture material that allows for sound to pass through cover 416 and into the acoustic chamber. For example, cover 416 may be formed of a mesh or porous membrane that includes openings or pores through which a controlled level of sound may pass. In this aspect, the cover 416 may further provide a mechanism for controlling or otherwise tuning an acoustic performance of earcup 102. Alternatively, cover 416 may provide an acoustic seal between frame members 402A-402D so that sound cannot be transmitted through cover 416 and into the acoustic chamber, for example, a plastic or closed texture material.

In addition, in some embodiments, each of frame members 402A-402D may include acoustic pores 418 for further tuning the acoustic performance of earcup 102. Acoustic pores 418 may be calibrated to achieve a desired level of acoustic tuning and/or include an acoustic mesh 420 over the pores 418, for further tuning of an acoustic performance of earcup 102. It should be understood that although three mesh covered acoustic pores 418 are shown on each of frame members 402A-402D, any number of pores with or without a mesh may be provided. In addition, in some embodiments where cover 416 is formed of, for example, a porous material, acoustic pores 418 may not be necessary and therefore omitted. Alternatively, where cover 416 is made of an acoustically isolating material, acoustic pores 418 with or without acoustic mesh 420 may be used alone for acoustic tuning.

Figure 6:
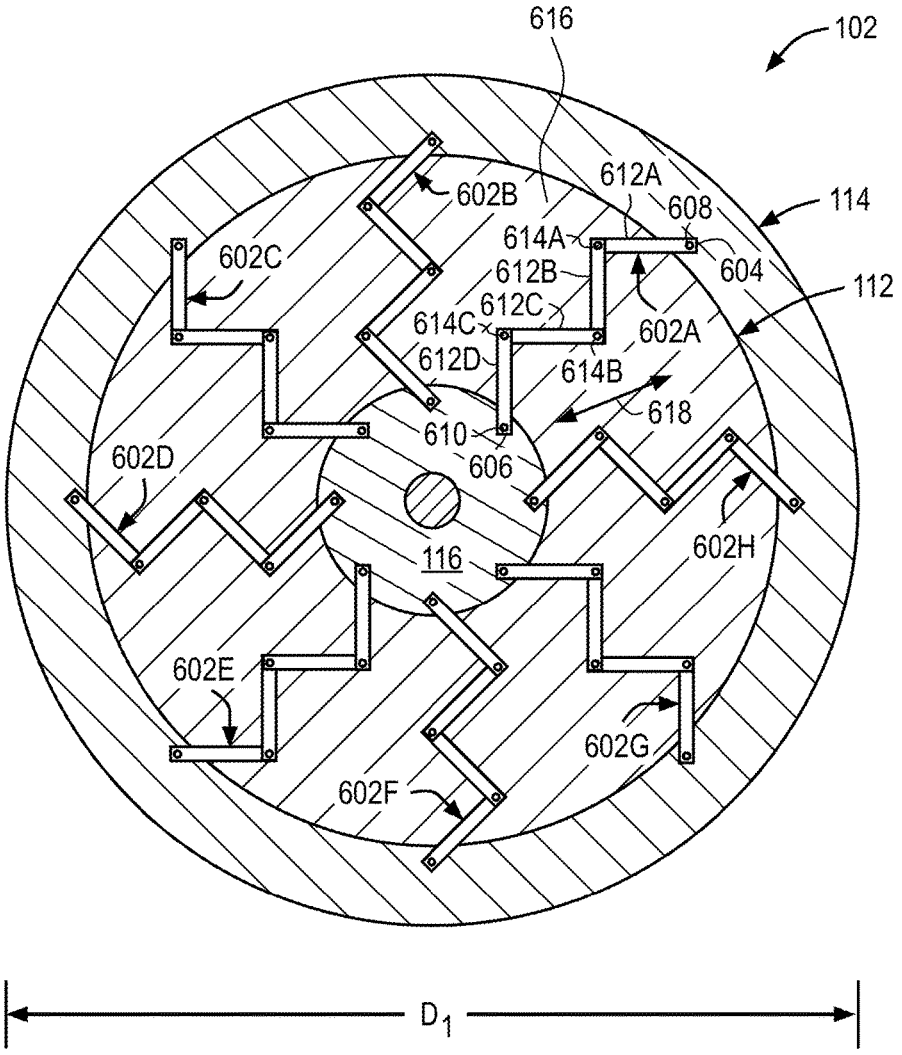
FIG. 6 illustrates a schematic top plan view of another embodiment of a headphone earcup in a first configuration.

FIG. 6 illustrates a schematic top plan view of another embodiment of a headphone earcup in a first configuration. Earcup 102 is substantially the same as, and operates in the same manner as, the earcup 102 described in reference to FIGS. 1-3. In this aspect, as previously discussed, earcup 102 includes earcup frame 112, earpad 114 connected to earcup frame 112 and transducer 116 also connected to earcup frame 112. Earcup frame 112 includes additional features to facilitate the conversion of earcup 102 between the first and second configurations (e.g., between a circumaural and a supra-aural earcup). In particular, in this embodiment, earcup frame 112 includes one or more frame members 602A, 602B, 602C, 602D, 602E, 602F, 602G and 602H extending radially outward from transducer 116 to earpad 114. Frame members 602A-602H, in this embodiment, may be cantilever like members, fin like members, struts, trusses, beams or the like that are made up of articulated or jointed sections that can collapse (or contract) and expand to convert earcup 102 between the first and second configurations. For example, frame members 602A-602H may be jointed struts or truss like members that operate in a scissor like manner, much like a Hoberman Sphere®. Frame members 602A-602H may be curved toward earpad 114 so as to form a cup, cone or other similarly shaped acoustic chamber around the ear (as shown in FIGS. 2-3). For example, in one embodiment, frame members 602A-602H may be formed of a plastic material or the like that can be formed into the desired shape and size. It should further be understood that although eight frame members 602A-602H are shown, any number of frame members may be provided.

Each of frame members 602A-602H may include an outer end 604 attached to earpad 114 and an inner end 606 attached to transducer 116. Both outer and inner ends 604, 606 of each of frame members 602A-602H may be pivotally attached to the earpad 114 and transducer 116, respectively, by attachment members 608, 610, respectively. The attachment members 608, 610, may for example, be pins or any other type of attachment member that holds two structures together and allows one structure to pivot with respect to the other. In addition, each of frame members 602A-602H may include a number of frame sections 612A, 612B, 612C and 612D which are pivotally connected to one another by pivot members 614A, 614B and 614C (e.g., pins or the like) to form a number of articulated or jointed regions between the outer and inner ends 604, 606 of each of frame members 602A-602H. It should further be recognized that although frame members 602A-602H are shown attached to transducer, they may be attached to any other mounting member centrally located within earcup 102, for example, a central part of a casing to which transducer 116 is mounted.

Figure 7:
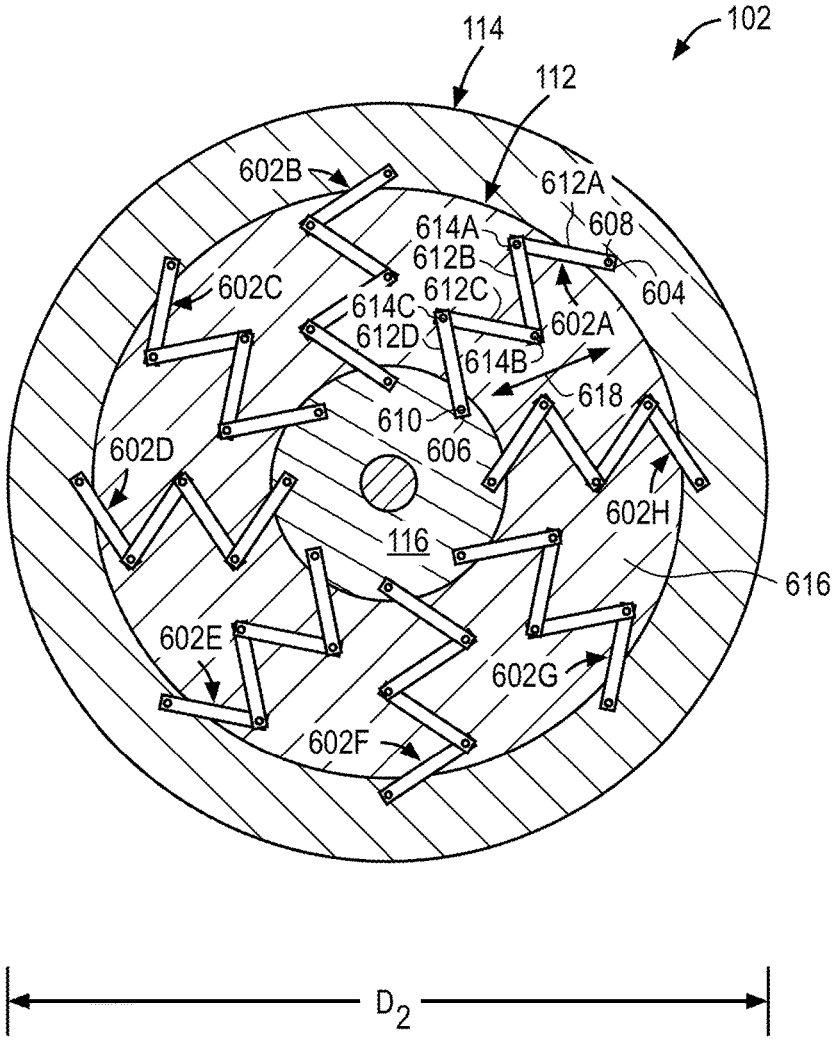
FIG. 7 illustrates a schematic top plan view of one embodiment of the headphone earcup of FIG. 6 in a second configuration.

Frame sections 612A-612D may pivot around the pivot members 614A-614C at the jointed regions in a scissor like fashion to either pull earpad 114 in toward transducer 116 (e.g., decrease the diameter) or push earpad 114 away from transducer 116 (e.g., increase the diameter) in a radial direction as illustrated by arrow 618. Said another way, an overall length of frame member 602A in a radial direction may be decreased or increased by collapsing or expanding frame sections 612A-612D with respect to one another. This, in turn, converts earpad 114, which is attached to each of frame members 602A-602H around its circumference, between diameter $D_1$ as shown in FIG. 6 and diameter $D_2$ as shown in FIG. 7. For example as can be seen from FIG. 6, when one or more of frame members 602A-602H are expanded (e.g., in a radial direction with respect to transducer 116), a circumference of earpad 114 is maximized and earpad 114 is at its largest diameter, or $D_1$. To reduce the circumference or diameter of earpad 114, frame sections 612A-612D are contracted in a scissor like manner such that the outer ends 604, which are connected to earpad 114, pull earpad 114 in toward transducer, which in turn reduces the circumference and diameter of earpad 114 to $D_2$, as shown in FIG. 7. The movement of frame members 602A-602H may be driven manually by a user, or automatically, such as by a controller within earcup 102.

In addition, it should be understood that although frame members 602A-602H are illustrated as being one elongated structure made up of several sections, frame members 602A-602H may include two or more elongated structures that intersect in a scissor like fashion, much like a Hoberman Sphere®. For example, each of members 602A-602H may include a second jointed frame member that crisscrosses with it at the jointed regions in a scissor like fashion, and all the frame members may be interconnected such that movement of one of the frame members, moves the entire earcup frame 112 between the collapsed and expanded configurations.

Earpad 114 may be a ring shaped structure that can expand and contract based on the movement of frame members 602A-602H, while still maintaining a ring shape. For example, earpad 114 may be made of a continuous piece of flexible elastic material, elastomeric material, foam, polyurethane or silicon based material. Alternatively, earpad 114 may be made of curved material sections, which are drawn close or farther apart depending upon the movement of frame members 602A-602H.

Earcup frame 112 may further include a cover 616 that covers, or otherwise fills in, the gaps between frame members 602A-602H to complete the acoustic chamber. Cover 616 may be substantially similar to cover 416 described in reference to FIG. 4. Representatively, cover 616 may be made of a material, such as a fabric or plastic, that can fit over and/or around the frame members 602A-602H and then be attached thereto to create an enclosed chamber. In one embodiment, cover 616 may be formed of an acoustic or otherwise open texture material that allows for sound to pass through cover 616 and into the acoustic chamber. For example, cover 616 may be formed of a mesh or porous membrane that includes openings or pores through which a controlled level of sound may pass. In this aspect, the cover 616 may further provide a mechanism for controlling or otherwise tuning an acoustic performance of earcup 102. Alternatively, cover 616 may provide an acoustic seal between frame members 602A-602H so that sound cannot be transmitted through cover 616 and into the acoustic chamber, for example, a plastic or closed texture material. In this aspect, acoustic tuning may be accomplished by including pores (with or without an acoustic mesh covering) within frame members 602A-602H as previously discussed in reference to FIG. 4.

Figure 8:
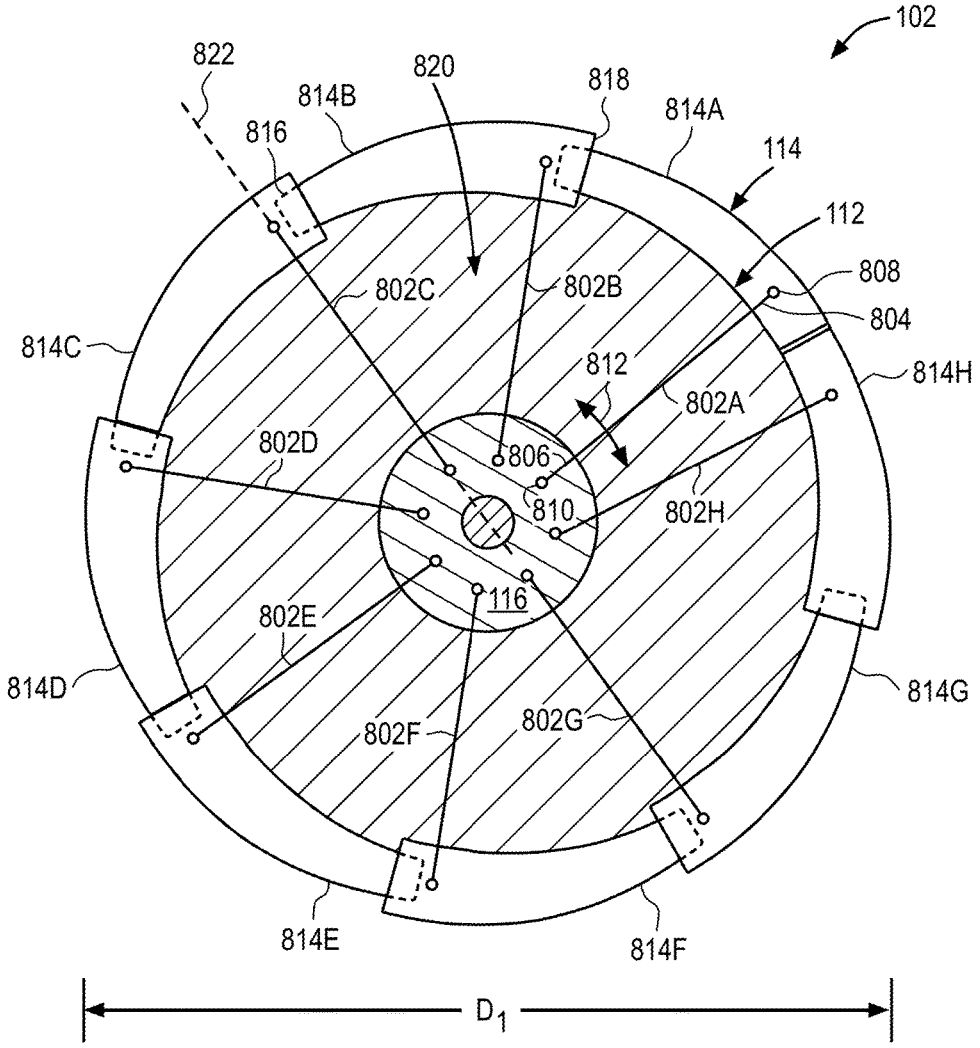
FIG. 8 illustrates a schematic top plan view of another embodiment of a headphone earcup in a first configuration.

FIG. 8 illustrates a schematic top plan view of another embodiment of a headphone earcup in a first configuration. Earcup 102 is substantially the same as, and operates in the same manner as, the earcup 102 described in reference to FIGS. 1-3. In this aspect, as previously discussed, earcup 102 includes earcup frame 112, earpad 114 connected to earcup frame 112 and transducer 116 also connected to earcup frame 112. Earcup frame 112 includes additional features to facilitate the conversion of earcup 102 between the first and second configurations (e.g., between a circumaural and a supra-aural earcup). In particular, in this embodiment, earcup frame 112 includes one or more frame members 802A, 802B, 802C, 802D, 802E, 802F, 802G and 802H extending radially outward from transducer 116 to earpad 114. Frame members 802A-802H, in this embodiment, may be cantilever like members, fin like members, struts, trusses, beams or the can be used to convert the earcup 102 between the first and second configurations. Frame members 802A-802H may be curved toward earpad 114 so as to form a cup, cone or other similarly shaped acoustic chamber around the ear (as shown in FIGS. 2-3). For example, in one embodiment, frame members 802A-802H may be formed of a plastic material or the like that can be formed into the desired shape and size. It should further be understood that although eight frame members 802A-802H are shown, any number of frame members may be provided.

Each of frame members 802A-802H may include an outer end 804 attached to earpad 114 and an inner end 806 attached to transducer 116. Both outer and inner ends 804, 806 of each of frame members 802A-802H may be fixedly or pivotally attached to the earpad 114 and transducer 116, respectively, by attachment members 808, 810, respectively. In the case where pivoting is desired, attachment members 808, 810, may for example, be pins or any other type of attachment member that holds two structures together and allows one structure to pivot with respect to the other. In the case where it is desired for one or more of frame members 802A-802H to be fixed to the earpad 114 and/or transducer 116, the attachment members 808, 810 may be bolts, screws or the like. It should further be recognized that although frame members 802A-802H are shown attached to transducer, they may be attached to any other mounting member centrally located within earcup 102, for example, a central part of a casing to which transducer 116 is mounted.

Figure 9:
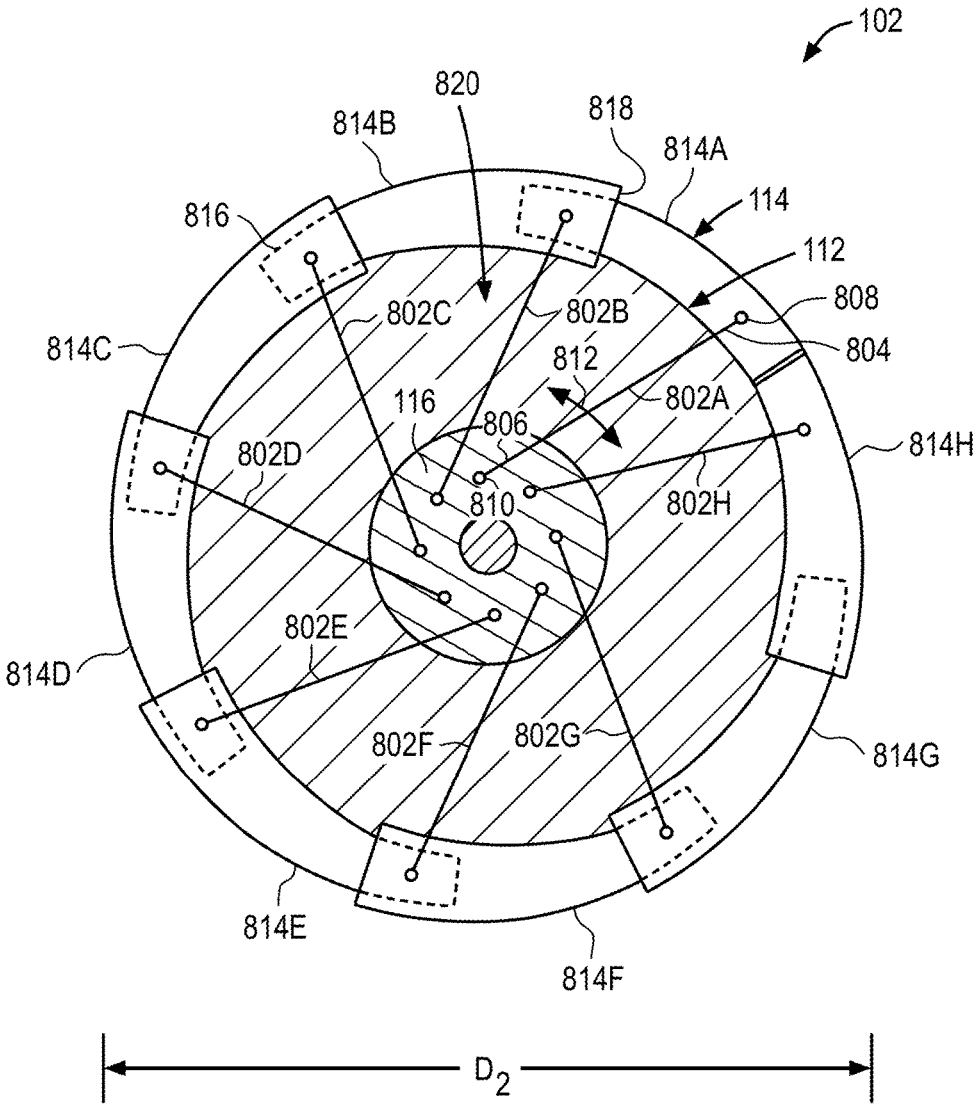
FIG. 9 illustrates a schematic top plan view of one embodiment of the headphone earcup of FIG. 8 in a second configuration.

In one embodiment, one or more of frame members 802A-802H may pivot around one or both of attachment members 808, 810 as shown by arrow 812 to convert earcup 102 between the first and second configurations. For example as can be seen from FIG. 8, when one or more of frame members 802A-802H are positioned such that an axis 822 along a length dimension of the member (e.g., in a radial direction with respect to transducer 116) is substantially perpendicular to a line tangent to the surface of transducer 116 (e.g., axis 822 intersects a center of transducer 116), a circumference of earpad 114 is maximized and earpad 114 is at its largest diameter, or $D_1$. To reduce the circumference or diameter of earpad 114, the inner ends 806 of frame members 802A-802H pivot in a direction of arrow 812 such that the outer ends 804, which are connected to earpad 114, rotate around transducer 116 pulling earpad 114 in toward transducer, which in turn reduces the circumference and diameter of earpad 114 to $D_2$, as shown in FIG. 9. The movement of frame members 802A-802H may be driven manually by a user, or automatically, such as by a controller within earcup 102.

In addition, in this embodiment, earpad 114 may be formed by telescoping sections 814A, 814B, 814C, 814D, 814E, 814F, 814G and 814H. Telescoping sections 814A-814H may form a ring shaped structure that can expand and contract, while still maintaining a ring shape. In particular, telescoping sections 814A-814H may be tubular, and in some cases horn shaped, structures that have a receiving end 818 and a sliding end 816. The receiving end 818 may be open and have a width, diameter and/or circumference greater than the sliding end 816. In other words, telescoping sections 814A-814H taper in a direction from the receiving end 818 to the sliding end 816 such that the sliding end 816 is narrower than the receiving end 818. Each receiving end 818 is aligned with a sliding end 816 of an adjacent one of telescoping sections 814A-814H such that the sliding end 816 can slide within the receiving end 818. In this aspect, a diameter of earpad 114 may be changed by sliding one or more of the telescoping sections 814A-814H within, or out of, another. For example, as shown in FIG. 8, telescoping sections 814A-814H are positioned such that the sliding ends 816 are near the edge of the adjacent receiving ends 818. In this aspect, earpad 114 is at diameter $D_1$ (e.g., a circumaural configuration). It should be noted that a clip, lip, protrusion, or other similar stopping member may be provided within and/or on the sliding ends 816 and/or the receiving ends 818 so that telescoping sections 814A-814H stop at a maximum extension point and do not separate. In addition, it should be noted that the receiving ends 818 may also include a stopping member (e.g., attachment member 808) so that the telescoping sections 814A-814H do not completely slide within the adjacent one of the telescoping sections 814A-814H. In addition, telescoping sections 814A-814H may be formed of an elastomer such as a silicon or polyurethane based material, for example, silicon sections overmolded with polyurethane for user comfort.

In addition, it should further be understood that in some embodiments, the end telescoping sections 814A and 814H are at a fixed position with respect to transducer 116 and do not slide within each other. Rather, the end telescoping sections 814A and 814H are fixedly attached to frame members 802A and 802H, respectively, by attachment members 808, 810, and anchored in place. In addition, it should be recognized that in some embodiments, only frame members 802A and 802H are used to position earpad 114 around transducer 116, and the remaining frame members 802B-802G are omitted. The ring shape of earpad 114 can still be maintained, however, due to the structure of the telescoping sections 814A-814H. In this embodiment, the conversion of earpad 114 between diameter $D_1$ and diameter $D_2$ can be achieved by drawing frame members 802A and 802H toward (e.g., to reduce diameter) or away (e.g., to increase diameter) from one another.

Earcup frame 112 may further include a cover 820 that covers, or otherwise fills in, the gaps between frame members 802A-802H to complete the acoustic chamber. Cover 820 may be substantially similar to cover 416 described in reference to FIG. 4. Representatively, cover 820 may be made of a material, such as a fabric or plastic, that can fit over and/or around the frame members 802A-802H and then be attached thereto to create an enclosed chamber. In one embodiment, cover 820 may be formed of an acoustic or otherwise open texture material that allows for sound to pass through cover 820 and into the acoustic chamber. For example, cover 820 may be formed of a mesh or porous membrane that includes openings or pores through which a controlled level of sound may pass. In this aspect, the cover 820 may further provide a mechanism for controlling or otherwise tuning an acoustic performance of earcup 102. Alternatively, cover 820 may provide an acoustic seal between frame members 802A-802H so that sound cannot be transmitted through cover 820 and into the acoustic chamber, for example, a plastic or closed texture material. In this aspect, acoustic tuning may be accomplished by including pores (with or without an acoustic mesh covering) within other parts of frame member 122, (e.g., frame members 802A-802H as previously discussed in reference to FIG. 4).

Figure 10:
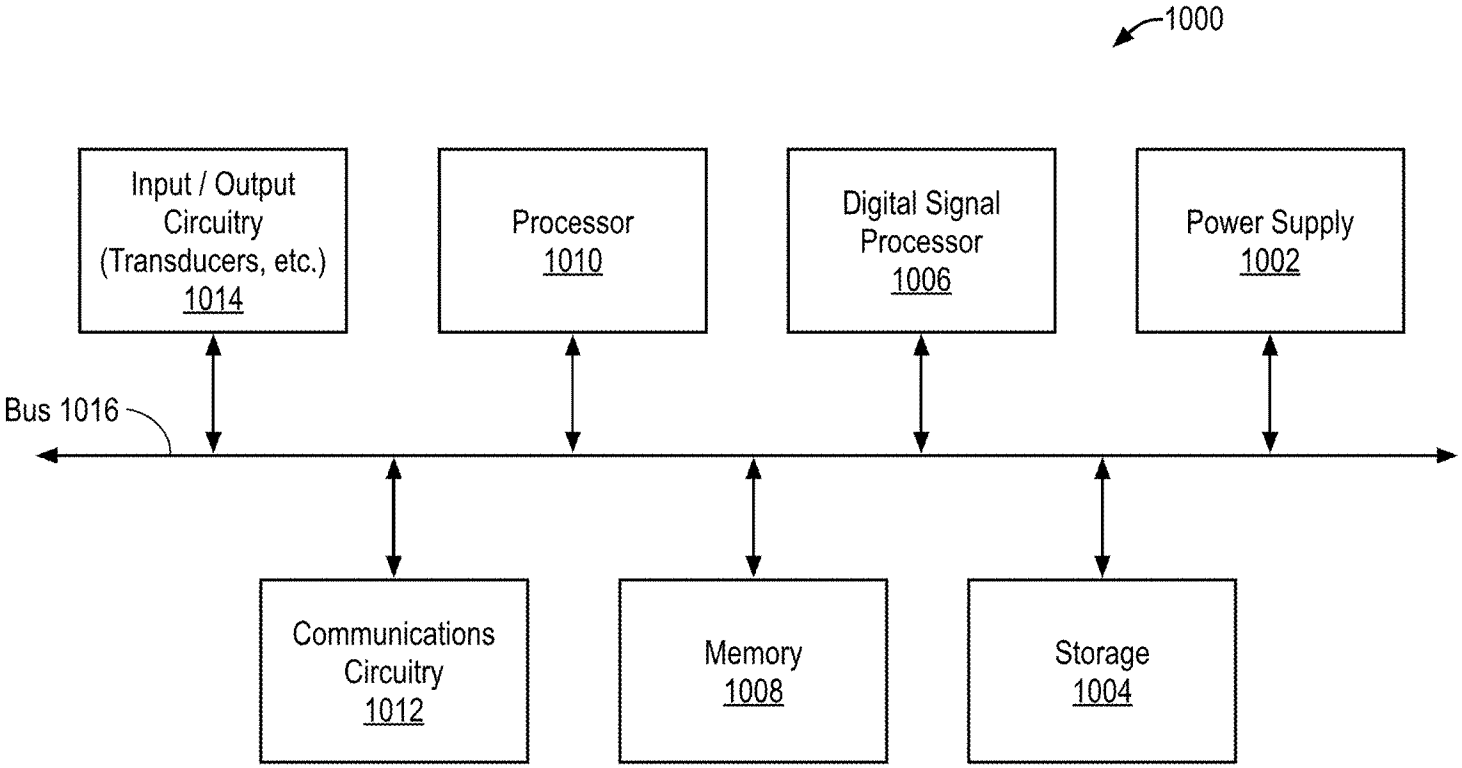
FIG. 10 illustrates a simplified schematic view of one embodiment of an electronic device in which convertible headphone earcups may be implemented.

FIG. 10 illustrates a simplified schematic view of one embodiment of an electronic device that is convertible between a circumaural and supra-aural configuration. For example, headphone 100 is an example of a system that can include some or all of the circuitry illustrated by electronic device 1000.

Electronic device 1000 can include, for example, power supply 1002, storage 1004, signal processor 1006, memory 1008, processor 1010, communication circuitry 1012, and input/output circuitry 1014. In some embodiments, electronic device 1000 can include more than one of each component of circuitry, but for the sake of simplicity, only one of each is shown in FIG. 10. In addition, one skilled in the art would appreciate that the functionality of certain components can be combined or omitted and that additional or less components, which are not shown in FIGS. 1-9, can be included in, for example, headphone 100, and more specifically earcup 102.

Power supply 1002 can provide power to the components of electronic device 1000. In some embodiments, power supply 1002 can be coupled to a power grid such as, for example, a wall outlet. In some embodiments, power supply 1002 can include one or more batteries for providing power to a headphone or other type of electronic device associated with the headphone. As another example, power supply 1002 can be configured to generate power from a natural source (e.g., solar power using solar cells).

Storage 1004 can include, for example, a hard-drive, flash memory, cache, ROM, and/or RAM. Additionally, storage 1004 can be local to and/or remote from electronic device 1000. For example, storage 1004 can include integrated storage medium, removable storage medium, storage space on a remote server, wireless storage medium, or any combination thereof. Furthermore, storage 1004 can store data such as, for example, system data, user profile data, and any other relevant data.

Signal processor 1006 can be, for example a digital signal processor, used for real-time processing of digital signals that are converted from analog signals by, for example, input/output circuitry 1014. After processing of the digital signals has been completed, the digital signals could then be converted back into analog signals. For example, the signal processor 1006 could be used to analyze digitized audio signals received from the error microphone to determine how much of the audio signal is ambient noise or earcup noise and how much of the audio signal is, for example, music signals.

Memory 1008 can include any form of temporary memory such as RAM, buffers, and/or cache. Memory 1008 can also be used for storing data used to operate electronic device applications (e.g., operation system instructions).

In addition to signal processor 1006, electronic device 1000 can additionally contain general processor 1010. Processor 1010 can be capable of interpreting system instructions and processing data. For example, processor 1010 can be capable of executing instructions or programs such as system applications, firmware applications, and/or any other application. Additionally, processor 1010 has the capability to execute instructions in order to communicate with any or all of the components of electronic device 1000. For example, processor 1010 can execute instructions stored in memory 1008 to convert earcup 102 between the circumaural and supra-aural configurations disclosed herein.

Communication circuitry 1012 may be any suitable communications circuitry operative to initiate a communications request, connect to a communications network, and/or to transmit communications data to one or more servers or devices within the communications network. For example, communications circuitry 1012 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 1014 can convert (and encode/decode, if necessary) analog signals and other signals (e.g., physical contact inputs, physical movements, analog audio signals, etc.) into digital data. Input/output circuitry 1014 can also convert digital data into any other type of signal. The digital data can be provided to and received from processor 1010, storage 1004, memory 1008, signal processor 1006, or any other component of electronic device 1000. Input/output circuitry 1014 can be used to interface with any suitable input or output devices, such as, for example, pressure sensor 206 and acoustic sensor 208 described in reference to FIGS. 2-3. Furthermore, electronic device 1000 can include specialized input circuitry associated with input devices such as, for example, one or more proximity sensors, accelerometers, etc. Electronic device 1000 can also include specialized output circuitry associated with output devices such as, for example, one or more speakers, earphones, headphones, etc.

Lastly, bus 1016 can provide a data transfer path for transferring data to, from, or between processor 1010, storage 1004, memory 1008, communications circuitry 1012, and any other component included in electronic device 1000. Although bus 1016 is illustrated as a single component in FIG. 10, one skilled in the art would appreciate that electronic device 1000 may include one or more components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while frame members which could be formed of a realtively stiff material and/or jointed are described, the frame members could be made of springs or other resilient members which can expand and contract to change a diameter of the earcup. The description is thus to be regarded as illustrative instead of limiting.

What is claimed is:

1. A convertible earcup for a headphone, the earcup comprising:

an earcup frame having a plurality of frame members;

a driver positioned within the earcup frame; and an earpad coupled to the plurality of frame members, the earpad operable to be converted between a first configuration in which the earpad comprises a first diameter and a second configuration in which the earpad comprises a second, different diameter.

2. The earcup of claim 1 wherein the plurality of frame members are struts extending radially outward from the driver to the earpad.

3. The earcup of claim 1 wherein the plurality of frame members are articulated frame members extending radially outward from the driver to the earpad, and wherein the articulated frame members are operable to expand and contract to convert the earpad between the first configuration and the second configuration.

4. The earcup of claim 1 wherein the earcup frame comprises an acoustic mesh for tuning an acoustic performance of the earcup.

5. The earcup of claim 1 wherein when the earpad is in the first configuration, the earpad is dimensioned to encircle an ear.

6. The earcup of claim 1 wherein when the earpad is in the second configuration, the earpad is dimensioned to rest on an ear.

7. The earcup of claim 1 wherein the plurality of frame members are operable to maintain a constant distance between a face of the driver and an ear canal of a user when the earpad is in the first configuration and in the second configuration.

8. The earcup of claim 1 wherein the earpad is convertible to any diameter between the first diameter and the second diameter.

9. The earcup of claim 1 wherein the earpad is a ring shaped member comprising an elastomeric material.

10. The earcup of claim 1 wherein the earpad comprises a plurality of telescoping sections that form a ring shaped earpad.

11. The earcup of claim 1 wherein the earcup further comprises:

one of a position sensor or an acoustic sensor coupled to the earpad to detect whether the earpad is in the first configuration or the second configuration.

12. An earcup for a headphone, the earcup comprising:

an earcup frame having a plurality of frame members that are each adjustable between a first configuration and a second configuration;

a speaker unit positioned within the earcup frame; and an earpad coupled to the earcup frame, wherein the earpad comprises a first diameter when each of the plurality of frame members are in the first configuration and a second diameter when each of the plurality of frame members are in the second configuration.

13. The earcup of claim 12 wherein the plurality of frame members are struts operable to adjust the earcup frame between the first configuration and the second configuration.

14. The earcup of claim 12 wherein the plurality of frame members are at least two jointed frame members, wherein the jointed frame members contract or expand to adjust the earcup frame between the first configuration and the second configuration.

15. The earcup of claim 12 wherein the plurality of frame members extend radially outward from the speaker unit to the earpad, and wherein at least one of the plurality of frame members comprises an acoustic opening for tuning an acoustic performance of the earpad.

16. The earcup of claim 12 wherein a volume defined by the earcup frame when the plurality of frame members are in the first configuration is different than a volume define by the earcup frame when the plurality of frame members are in the second configuration.

17. The earcup of claim 12 wherein the earcup further comprises:

a covering coupled to the earcup frame, wherein the covering comprises a porous material operable to tune an acoustic performance of the earcup.

18. The earcup of claim 12 wherein a distance between a face of the speaker unit and an ear around which the earcup frame is positioned remains constant when the plurality of frame members are in the first configuration and the second configuration.

19. A convertible headphone system comprising:

a set of earcups, wherein each earcup within the set of earcups comprises a speaker unit, a plurality of frame members extending radially outward from the speaker unit and an earpad connected to the plurality of frame members, and wherein each of the plurality of frame members is separately movable with respect to the speaker unit, and the earpad is convertible between a first diameter and a second diameter.

20. The convertible headphone system of claim 19 wherein the earcup is a circumaural earcup in the first diameter and a supra-aural earcup in the second diameter.

* * * * *